US007194938B2

(12) United States Patent
Hollar

(10) Patent No.: US 7,194,938 B2
(45) Date of Patent: Mar. 27, 2007

(54) ANGULAR IMPACT WRENCH

(76) Inventor: Kenneth Gene Hollar, 21922 Main St., Richton Park, IL (US) 60471

( * ) Notice: Subject to any disclaimer, the term of this patent is extended or adjusted under 35 U.S.C. 154(b) by 0 days.

(21) Appl. No.: 11/157,717

(22) Filed: Jun. 21, 2005

(65) Prior Publication Data

US 2005/0279196 A1 Dec. 22, 2005

Related U.S. Application Data

(60) Provisional application No. 60/581,520, filed on Jun. 21, 2004.

(51) Int. Cl.
*B25B 19/00* (2006.01)

(52) U.S. Cl. ..... 81/463; 173/93

(58) Field of Classification Search ..... 81/463, 81/465, 466, 464; 173/93, 93.7, 93.5
See application file for complete search history.

(56) References Cited

U.S. PATENT DOCUMENTS 3,083,598 A * 4/1963 Kinnison ..... 81/124.3
3,273,428 A 9/1966 Rudeke
3,912,022 A * 10/1975 Smith ..... 173/93.7
5,960,685 A * 10/1999 Shyong-Chuan et al. ..... 81/463
6,386,078 B1 * 5/2002 Wu ..... 81/463
6,502,485 B1 1/2003 Salazar
6,769,334 B1 8/2004 Whitehead et al.

* cited by examiner

*Primary Examiner*—Jacob K. Ackun, Jr.
(74) *Attorney, Agent, or Firm*—Leydig, Voit & Mayer, Ltd

(57) ABSTRACT

An angular impact wrench is disclosed. The angular impact wrench can comprise a lever that is rotatable about a pivot axis and a reciprocably movable ram that is operatively arranged with the lever to rotate the lever. The lever includes a concave contact surface that is positioned to receive a convex contact surface of the ram. The convex contact surface of the ram is engageable with the concave contact surface of the lever. The lever, in turn, is connected to a drive that is suitable for receiving a socket, for example. The rotatable lever transmits the linear movement of the ram to a rotational movement, thereby imparting a torque to the drive suitable for loosening or tightening a fastener. In some embodiments of the angular impact wrench, the wrench is a removable component suitable for connection to a standard air hammer. In other embodiments, the angular impact wrench of the present invention is an integral unit that is directly connectable to a power source, such as a source of compressed air.

18 Claims, 6 Drawing Sheets

ANGULAR IMPACT WRENCH

CROSS-REFERENCE TO RELATED PATENT APPLICATIONS

This patent application claims the benefit of priority to U.S. Provisional Application No. 60/581,520, filed Jun. 21, 2004, entitled "Angular Impact Wrench," which is incorporated in its entirety herein by reference.

FIELD OF THE INVENTION

The present invention relates generally to impact wrenches.

BACKGROUND OF THE INVENTION

When loosening a threaded bolt or nut, several times the amount of torque used to tighten it may be required to free the fastener. There are several reasons why this happens. One reason it that a standard V-thread is a self-locking thread. When a threaded fastener ages, it can corrode, and the threads will bind when trying to remove it. This is a problem for any equipment which is outdoors or in a corrosive environment. Another reason is that bonding agents, such as Loctite® adhesives from Henkel Corp. of Gulph Mills, Pa., are widely used to keep fasteners from vibrating loose. Bonding fluids work well, but make it even more difficult to remove the fastener. Impact guns are often used to remove these fasteners, and they work well if there is enough space to fit the gun with the socket disposed in the correct position over the fastener. Impact guns are becoming progressively more difficult to use because most machinery is getting smaller and more compact.

Prior art in this field uses mechanisms which allow only a line contact between the ram and lever. U.S. Pat. No. 3,273,428 to Rudeke shows contact between an anvil block 22 and a lug 23. The anvil block 22 has a flat surface, and the lug 23 has a rounded surface. This arrangement results in line contact through the stroke of the anvil block. U.S. Pat. No. 6,502,485 to Salazar shows contact between a striking pin 37 and a ratchet wrench head 34. The striking pin 37 has a flat contact surface and the ratchet wrench head 34 also has a flat surface which is rotatable. This arrangement results in line contact through almost the entire stroke. There is only one position in the stroke arrangement, i.e., when the two flat surfaces are parallel, where there is a rectangular area of contact between the striking pin 37 and the ratchet wrench head.

In this type of application, forces are very high. In order to reduce stress, contact area must be maximized. Line contact between two parts results in very low contact area which results in a poor transfer of impact and premature failure.

SUMMARY OF THE INVENTION

The invention provides an angular impact wrench. Advantageously, the angular impact wrench can fit in many places where an impact gun would not. Positioning the impact source to the side of the socket, rather than behind the socket, allows the angular impact wrench to fit on fasteners with less clearance. The angular impact wrench does not require the amount of swing room required for a breaker bar or an open end wrench, nor is room required to swing a hammer as is the case for some wrenches. The angular impact wrench is designed to be used with standard square drive sockets, but in other embodiments, the invention can be used with other types of wrench drives by changing the drive shaft.

The features of the present invention will become apparent to one of ordinary skill in the art upon reading the detailed description, in conjunction with the accompanying drawings, provided herein.

DESCRIPTION OF EMBODIMENTS OF THE INVENTION

Figure 1:
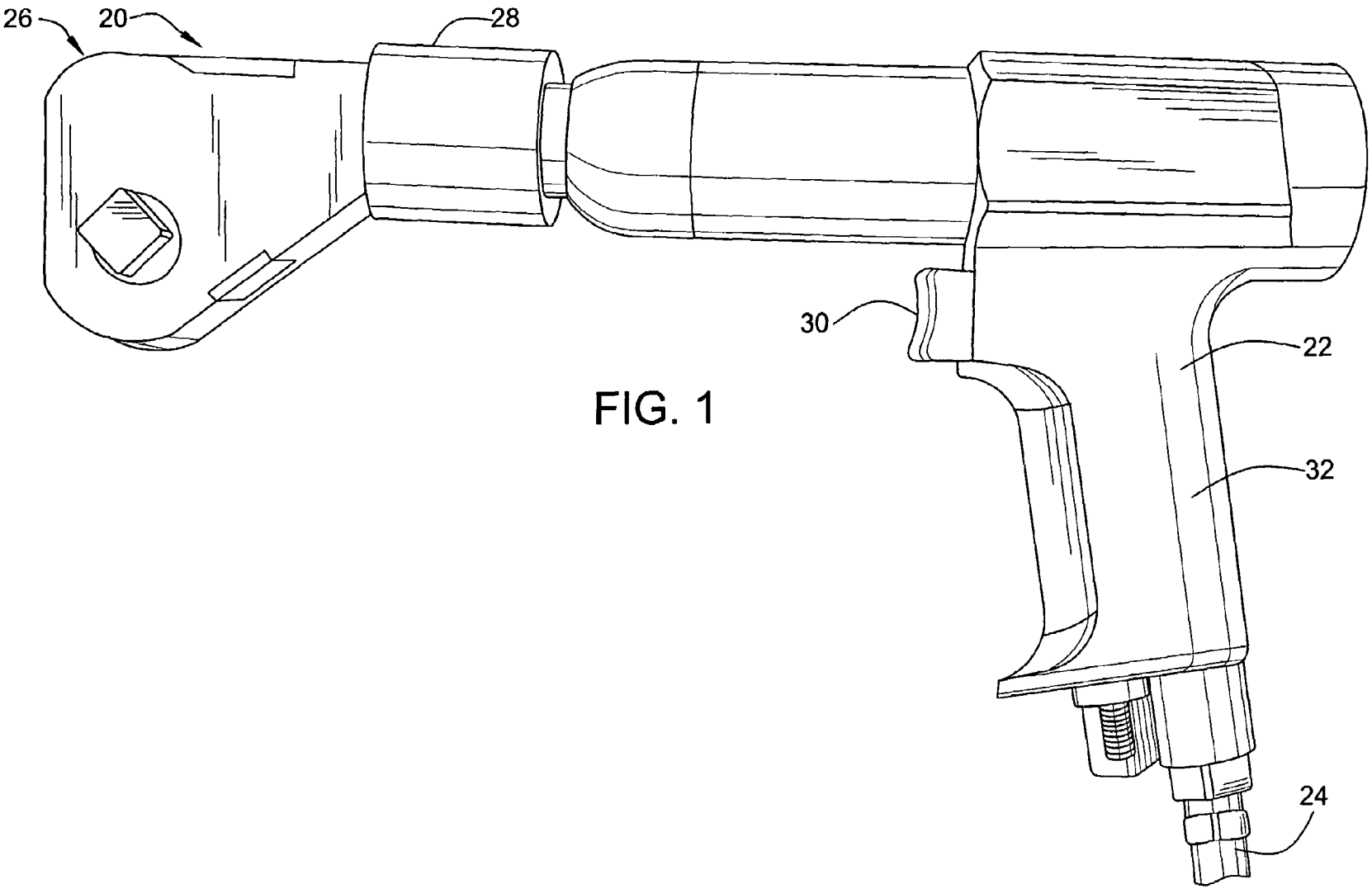
FIG. 1 is an elevational view of an embodiment of an angular impact wrench according to the present invention.

Turning now to the Figures, there is shown in FIG. 1 an embodiment of an angular impact wrench 20 according to the present invention. The angular impact wrench 20 includes an air hammer 22 having a supply hose 24 connected to a source of compressed air and a wrench head 26 connected to the hammer 22 via a threaded coupler 28. The air hammer 22 includes a trigger 30 that is disposed closely adjacent a handle portion 32 thereof. The trigger 30 can be selectively actuated by the user to allow compressed air to flow from the compressed air source into a hollow cylinder 34 of the hammer 22 (see FIG. 3).

Figure 3:
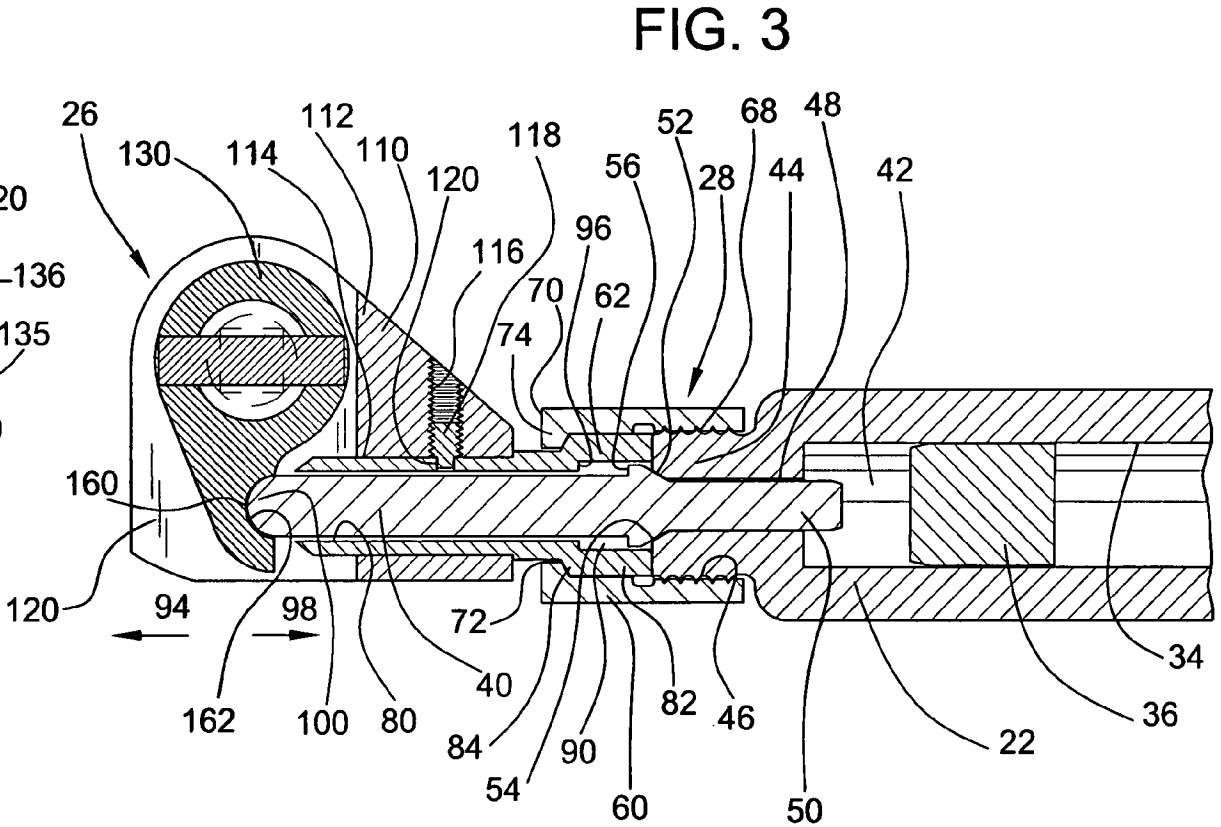
FIG. 3 is a fragmentary, cross-sectional view of the angular impact wrench taken along line 3—3 in FIG. 2.

Referring to FIG. 3, the hammer 22 includes a reciprocally movable piston 36 disposed within the cylinder 34. The powered reciprocating hammer 22 can be selectively operated via the trigger to supply a linear actuating impact to a ram 40 of the wrench head 26. The hammer can be powered by several different sources, such as compressed gas, hydraulic fluid, electricity, gun powder, internal combustion, or even steam. Examples of suitable air hammers for use with the present invention include those commercially available from Mack, Snap-On-Tool, Ingersoll-Rand, Chicago Pneumatic, and Sears Roebuck Company under the Craftsman brand. One of ordinary skill in the art will appreciate that the coupler 28 can be modified to be used with any suitable actuating device. For instance, commercially-available air hammers may have different thread diameters suitable for the coupler to threadedly engage. In different embodiments of the coupler, the coupler can have varying sizes to fit on the desired air hammer.

The piston 36 is reciprocally movable over a range of travel defined by a cylindrical passage 42 within the cylinder 34. The hammer 22 includes a distal end 44 having a threaded external surface 46, and a bore 48 extending therethrough and communicating with the passage 42. A proximate end 50 of the ram extends through the bore 48 and projects into the passage 42 such that the piston 36 can come in contacting relationship with the proximate end 50 of the ram 40.

The open distal end of the bore 48 includes a countersink surface 52. The ram 40 includes a tapered surface 54 at an intermediate position thereof. The tapered surface is configures such that it is substantially complementary to the countersink 52. The tapered surface 54 terminates in a shoulder 56. The tapered surface 54 of the ram cooperates with the countersink 52 of the hammer 22 to define the proximate end of travel for the ram 40. The shoulder 56 of the ram cooperates with the guide 62 to define a distal end point of travel for the ram 40. The ram 40 is reciprocally movable between the distal and proximate end points of travel.

The coupler 28 includes a collar 60 and a guide 62. The collar 60 is a generally tubular member having an internal threaded surface 68 extending axially along at least a portion thereof. The distal end 70 of the collar 60 has a hole 72 therethrough to allow the guide 62 and the ram 40 to extend therethrough. The hole 72 is configured such that the distal end 70 of the collar 60 has a flange 74 extending inwardly.

The guide 62 is hollow with a bore 80 extending therethrough to accommodate the ram 40. The proximate end 82 of the guide 62 has a flared portion 84 that extends outwardly a sufficient distance such that the flared portion 84 is in interfering relationship with the flange 74 of the collar 60 when the collar 60 is disposed over the guide 62 and threaded to the hammer 22. The axial length of the respective threaded surfaces 68, 46 of the collar 60 and the air hammer 22, along with the flared portion 84 of the guide 62, are configured such that the collar 60 can be threaded onto the hammer 22 to axially retain the guide 62.

The guide 62 includes a counterbore 90 at its proximate end 82. The counterbore 90 extends axially a predetermined distance to define an axial range of travel for the ram 40. The ram 40 can move axially in a drive direction 94 until the shoulder 56 contacts a distal end surface 96 of the counterbore 90, which is the distal end point of travel. The ram 40 can move in a retraction direction 98 until the tapered surface 54 of the ram 40 contacts the countersink 52 of the air hammer 22, which is the proximate end point of travel. When the ram is in the retracted position, as shown in FIG. 3, at the proximate end point of travel with the tapered surface 54 in contacting relationship with the countersink 52, a distal end 100 of the ram 40 extends from the guide 62, and the proximate end 50 of the ram 40 extends into the passage 42 of the air hammer 22.

The wrench head 26 includes a housing 110 having a body portion 112 with a bore 114 extending therethrough to accommodate the guide 62 and the ram 40. The body 112 includes a tapped hole 116 configured to accommodate a setscrew 118 therein. The setscrew 118 can be a dog-point setscrew with the guide 62 having a hole 120 therein to accommodate the point of the setscrew 118. The setscrew 118 can be aligned with the hole 120 of the guide 62, and the setscrew 118 can be threaded in the tapped hole 116 such that the dog-point of the setscrew 118 can be disposed within the hole 120 to retain the wrench head 126 on the guide 62.

Figure 2:
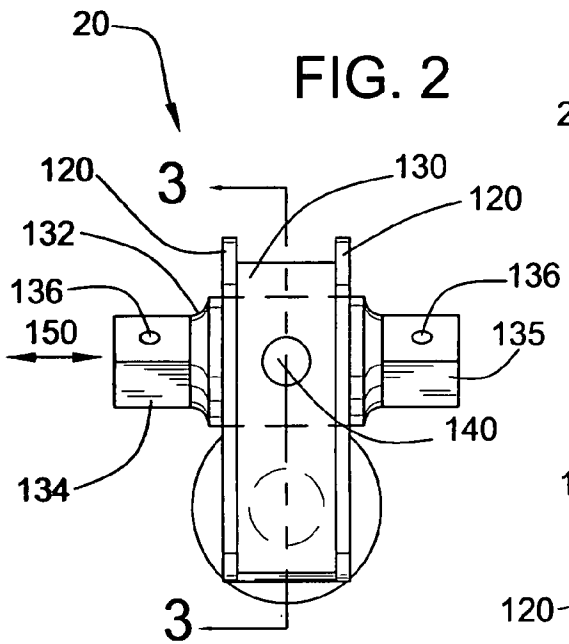
FIG. 2 is an end view of the angular impact wrench of FIG. 1.

Referring to FIG. 2, the housing 110 includes a pair of spaced-apart walls 120 extending from the body 112 thereof. The walls 120 are generally parallel to each other and in spaced relationship such that a lever 130 can be disposed therebetween. A drive shaft 132 extends through the walls 120 of the housing and the lever 130. Each end 134, 135 of the drive shaft 132 is configured to accept a square drive socket. Each end 134, 135 is in the form of a cube and has a ball bearing 136 disposed in a recess in one of its faces along with a spring to bias the ball bearing 136 into an outwardly extending position to act as a detent to removably retain a socket on each end 134, 135. The ball bearing 136 can be a ball having a diameter of approximately ⅛ inch.

In other embodiments, the drive shaft 132 can have different ends configured to accept different types of sockets. The drive shaft 132 can be equipped with first and second ends 134, 135 to allow the angular impact wrench 20 to be used to both tighten and loosen a fastener. The first end 134 can be used to drive a fastener in a clockwise direction when viewed from the second end 135 thereof, whereas the second end 135 can be used to drive a fastener in a counterclockwise direction when viewed from the first end 134 thereof.

A pin 140 can be provided to fix the drive shaft 132 relative to the lever 130. The pin 140 extends through the lever 130 and the drive shaft 132 to retain the drive shaft 132 such that the drive shaft 132 is prevented from moving along its longitudinal axis 150. The pin 140 connects the drive shaft 132 to the lever 130 such that the drive shaft and the lever are rotatably coupled together to rotate about the longitudinal axis 150 of the drive shaft 132. Interaction of the drive shaft 132 with the walls 120 of the housing 110 prevents the drive shaft 132 from moving in a direction perpendicular to the longitudinal axis 150, thereby preventing the lever 130 from also so moving. The intermediate portion 132 of the drive shaft acts as a bearing which allows the drive shaft 132 and the lever 130 to rotate about the longitudinal axis 150.

Figure 5:
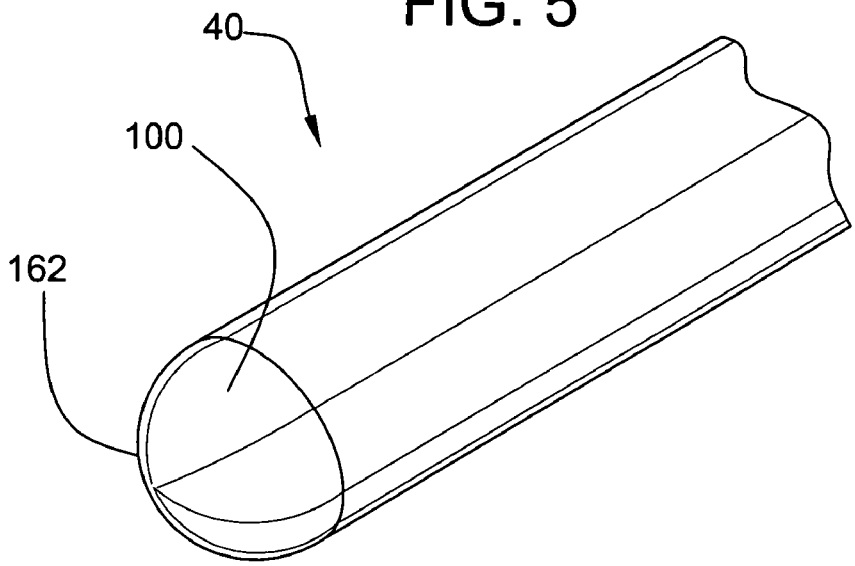
FIG. 5 is a fragmentary, perspective view of a ram useful in connection with the angular impact wrench of the present invention.

Referring to FIG. 3, the lever 130 is disposed in contacting relationship with the ram 40. The lever 130 includes a recess having a concave surface 160 that is substantially hemispherical. Referring the FIG. 5, the ram 40 includes a convex surface 162 at its distal end 100 that is substantially hemispherical in shape. The concave surface 160 of the lever 130 is complementary to the convex surface 162 of the ram 40. The convex surface 162 of the ram is configured to substantially conform to the concave surface 160 of the lever 130 and fits within the recess defined by the concave surface 160.

Figure 4:
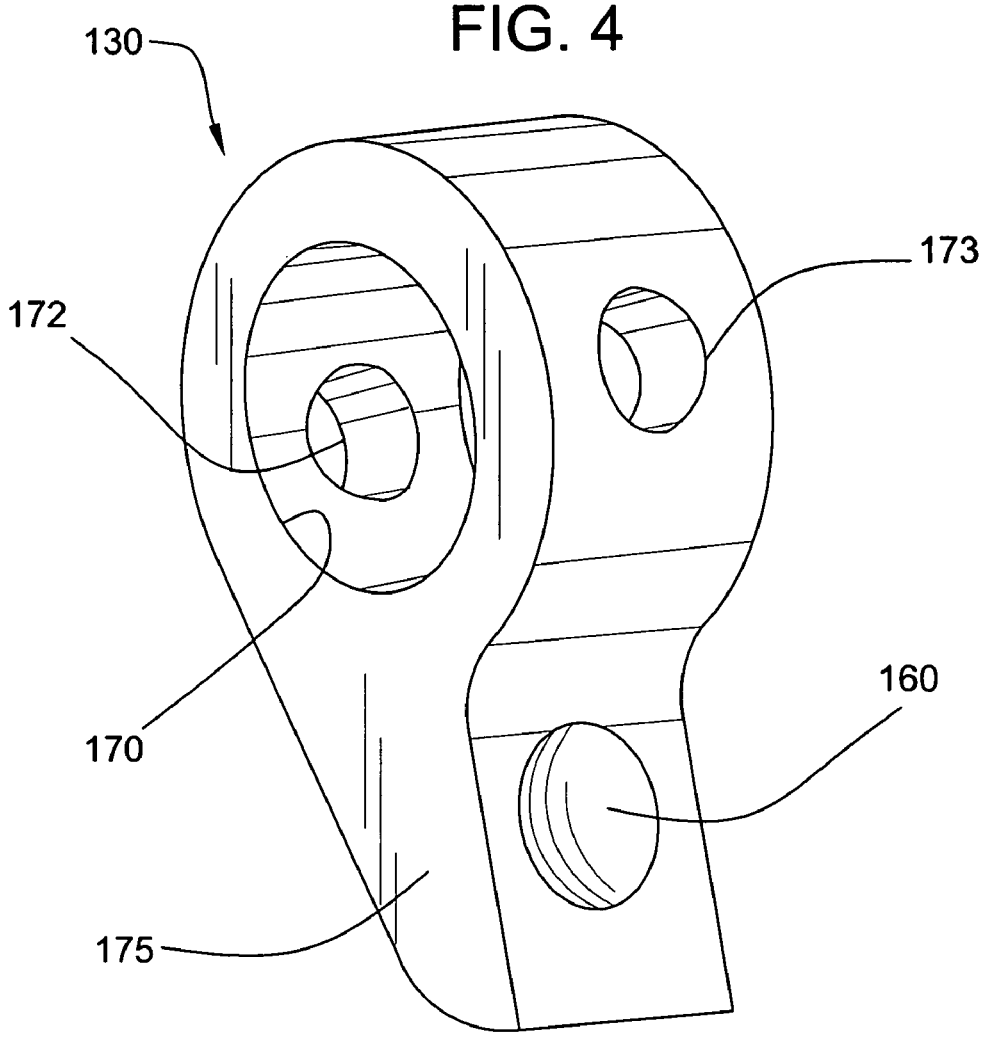
FIG. 4 is a perspective view of a lever useful in connection with the angular impact wrench of the present invention.

Referring to FIG. 4, the lever 130 includes a drive bore 170 for receiving the drive shaft therethrough and a pair of pin bores 172, 173 for receiving the pin therethrough. The drive shaft also has a pin bore for receiving the pin therethrough. The lever 130 includes an arm 175 in which the concave surface 160 is located. Location of the concave surface 160 relative to the axis of rotation established by the drive shaft substantially along the central axis of the drive bore 170 defines a moment arm for creating a torque upon the application of a linear actuating force via the ram 40.

In one assembly sequence, the lever 130 can be disposed between the walls 120 of the housing 110, as shown in FIGS. 2 and 3. Each wall 120 has a hole in it to accommodate the drive shaft. The drive shaft can be inserted through the hole of one of the walls 120, through the drive bore 170 of the lever 130, and through the hole of the other wall 120 such that the ends of the drive shaft 132 extend from either side of the housing 110. The drive shaft 132 can be rotated with respect to the lever 130 while it is in the drive bore 170 to align the pin bores 172, 173 of the lever 130 and the pin bore of the drive shaft so that the pin 140 can be inserted through the three pin bores. Once the pin 140 is disposed in the three pin bores, the lever 110 and the drive shaft 132 are rotatably coupled together, and the drive shaft and the lever are secured to the housing 110.

In one exemplary use of the angular impact wrench 20 of the present invention, the wrench can be used to free a fastener that is "frozen." The wrench head 26 can be fitted with a socket suitable for the particular fastener to be freed. The socket can be place over the fastener. The user can apply a torque to the lever 130 to maintain the lever 130 in contacting relationship with the ram 40. The user can operate the angular impact wrench 20 by squeezing the trigger 30 to allow compressed air to enter the passage 42 of the cylinder. The piston 36 can reciprocally move within the passage 42 such that the piston 36 periodically hammers against the ram 40. The user can continue to squeeze the trigger 30 to allow the piston 36 to repeatedly contact the ram 40. The ram 40, in turn, acts upon the lever 130 to create a torque which is transmitted to the drive 132 and to the socket mounted to the drive. The user can continue squeezing the trigger until the successive strikes of the piston against the ram work to loosen the fastener.

Figure 6:
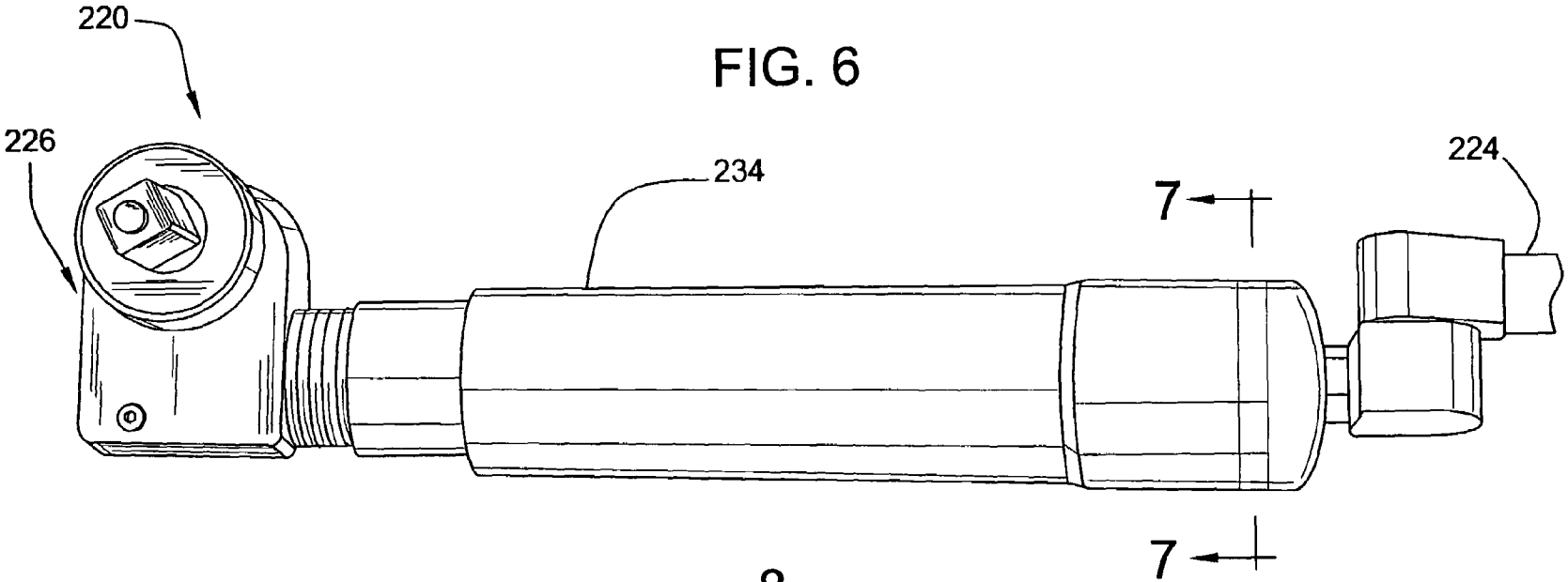
FIG. 6 is an elevational view of another embodiment of an angular impact wrench according to the present invention.
Figure 7:
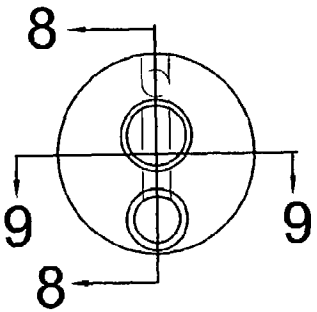
FIG. 7 is a cross-sectional view taken along line 7—7 in FIG. 6.
Figure 8:
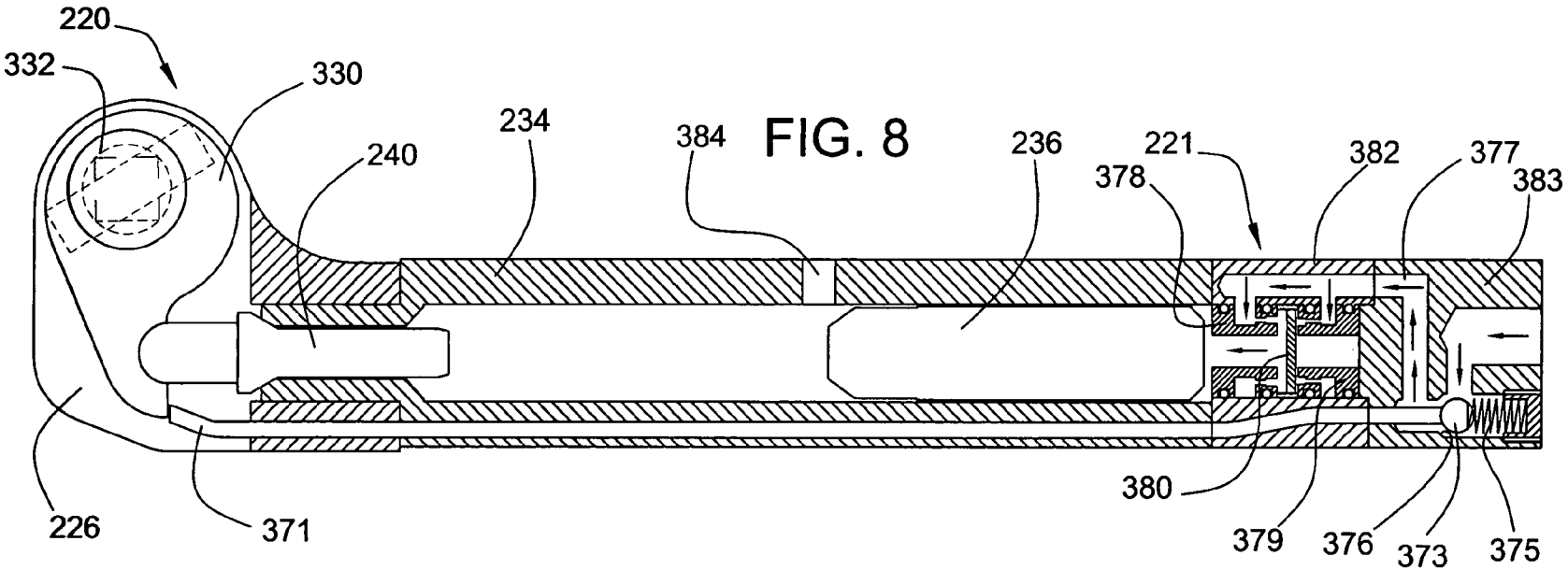
FIG. 8 is a cross-sectional view taken along line 8—8 in FIG. 7.

Referring to FIG. 6, another embodiment of an angular impact wrench 220 according to the present invention is shown. The angular impact wrench 220 is an integrated wrench suitable for direct connection to a power source for actuating the piston, such as a source of compressed air, for example. The angular impact wrench 220 includes a wrench head 226 connected to a cylinder 234 having at its proximate end a supply hose 224. Referring to FIG. 8, the angular impact wrench 220 includes a piston 236, a ram 240, a lever 330 and a drive shaft 332 that are substantially similar to those shown and described in connection with the angular impact wrench 20 of FIG. 1.

The angular impact wrench 220 of FIG. 6 further comprises an automatic actuating system 221 for automatically actuating the angular impact wrench upon the application of torque to the drive shaft. The automatic actuating system 221 can include a push rod 371 having a ball 373 disposed at its proximate end, a return spring 375 disposed in operative relationship to the ball 373 such that the ball 373 is biased toward a seat 376 to selectively seal a first air passage 377, a first spool 378, a second spool 379, a reciprocating disk valve 380, and first and second segments 382, 383. In FIG. 8, the wrench 220 is shown with the automatic actuating system 221 in an open position to allow air flow to act against the piston 236 to drive it toward the ram 240. The lever 330 has been rotated such that the push rod 371 has moved toward the proximate end of the wrench 220 to displace the ball 373 from the seat 376, thereby allowing air flow through the first passage 377. With the lever 330 and the ball 373 in the position shown in FIG. 8, the piston 236 will be driven into contacting relationship with the ram 240.

Figure 9:
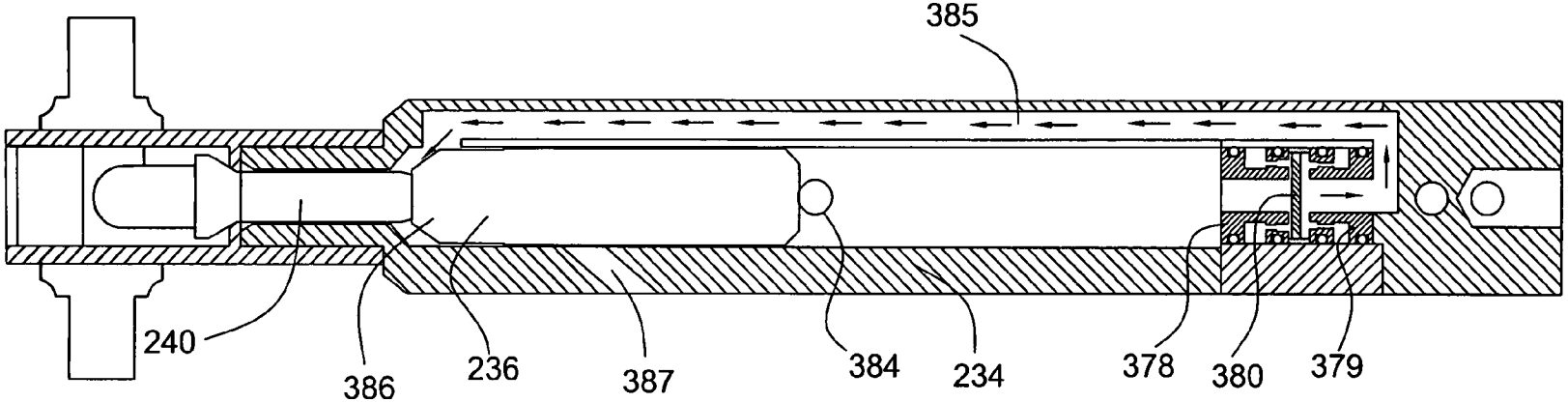
FIG. 9 is a cross-sectional view taken along line 9—9 in FIG. 7.

Referring to FIG. 9, the piston 236 is shown in contacting relationship with the ram 240. The piston 236 has cleared a first port 384 of the cylinder 234. The reciprocating disk valve 380 has moved from being closely adjacent to the second spool 379, as shown in FIG. 8, to being closely adjacent to the first spool 378, thereby sealing the first passage 377 such that compressed air no longer drives the piston 236 toward the ram 240. With the reciprocating disk valve 380 closely adjacent the first spool 378, a second air flow passage 385 is opened that directs compressed air against the distal end 386 of the piston 236, thereby driving the piston 236 back toward the spools 378, 379. After traveling a predetermined distance back toward the spools 378, 379, the piston 236 clears a second port 387. The air pressure acting against the piston 236 decreases. The reciprocating disk 380 returns to the position shown in FIG. 8.

Figure 10:
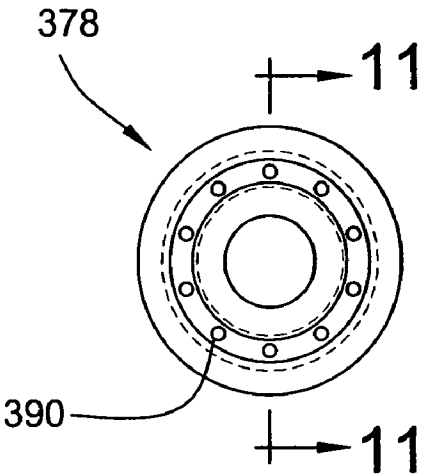
FIG. 10 is an end view of an intermediate spool of the angular impact wrench of FIG. 6.
Figure 11:
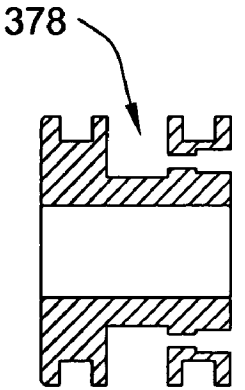
FIG. 11 is a cross-sectional view taken along line 11—11 in FIG. 10.
Figure 12:
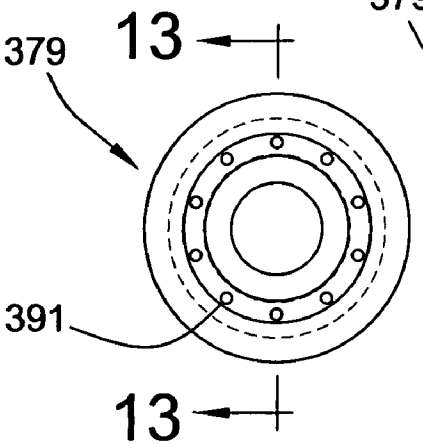
FIG. 12 is an end view of an end spool of the angular impact wrench of FIG. 6.
Figure 13:
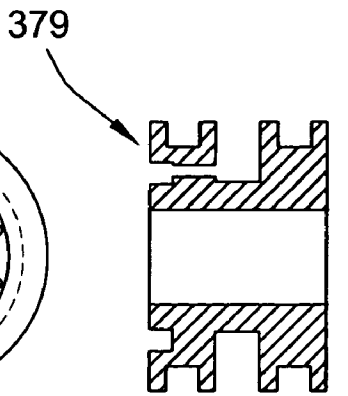
FIG. 13 is a cross-sectional view taken along the line 13—13 in FIG. 12.

Referring to FIGS. 10 and 11, the first spool 378 is shown. Referring to FIGS. 12 and 13, the second spool 379 is shown. The first and second spools 378, 379 have a plurality of openings 390, 391, respectively, arranged regularly around the spool.

Figure 14:
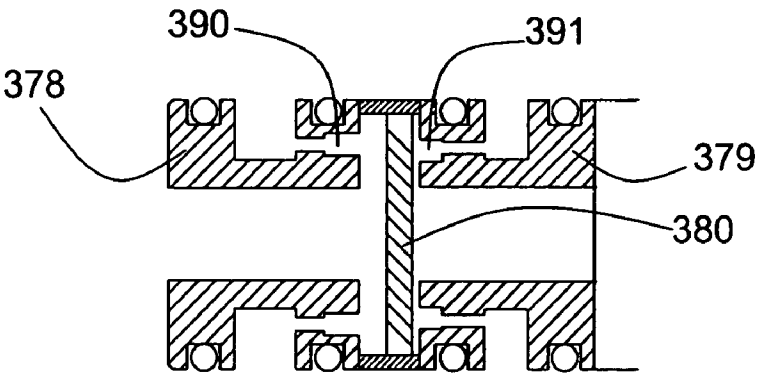
FIG. 14 is a fragmentary, enlarged sectional view of the intermediate and end spools of FIGS. 10 and 13, respectively, showing a reciprocating disk valve disposed therebetween.

Referring to FIG. 14, the reciprocating disk 380 is biased toward the position shown in FIG. 8 by virtue of the openings 390 of the first spool having a greater area than that of the openings 391 of the second spool 379, thereby creating a force differential that urges the reciprocating disk valve 380 toward a position closely adjacent the second spool 379.

In use, the user actuates the wrench 220 by applying a torque to the lever 330, which in turn moves the push rod to an open position to allow air flow to act against the piston 236. The reciprocal movement of the piston 236 alternately opens and closes flow passages defined within the wrench 220 to allow the piston 236 to move in a reciprocal fashion. The wrench head 226 and the first and second segments 382, 383 can be connected to the cylinder 234 by any suitable technique, such as Loctite® 262 adhesive.

The angular impact wrench converts linear guided impact into rotational impact using the lever-ram mechanism. The lever 130 is guided in a radial direction by the drive shaft 132. The lever 130 is contacted by the Ram 40. As shown in FIG. 4, the convex surface 162 of the ram 40 is disposed in contacting relationship with the concave surface 160 of the lever 130. The mating of the two surfaces 160, 162 allows maximum contact area throughout the stroke of the lever 40 while correcting any misalignment. The contact of the curved surfaces results in an efficient transfer of impact force from the ram 40 to the lever 130 and reduces the deformation in both the lever and the ram. This feature also makes the wrench durable and reliable.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise indicated.

While the invention is described herein in connection with certain preferred embodiments, there is no intent to limit the present invention to those embodiments. On the contrary, it is recognized that various changes and modifications to the described embodiments will be apparent to those skilled in the art upon reading the foregoing description, and that such changes and modifications may be made without departing from the spirit and scope of the present invention. The inventors expect skilled artisans to employ such variations as appropriate, and the inventors intend for the invention to be practiced otherwise than as specifically described herein. Accordingly, the intent is to cover all alternatives, modifications, and equivalents included within the spirit and scope of the invention. Moreover, any combination of the above-described elements in all possible variations thereof is encompassed by the invention unless otherwise indicated herein or otherwise clearly contradicted by context.

What is claimed is:

1. An angular impact wrench comprising:

a lever rotatable about a pivot axis, the lever including an arm having one of a concave contact surface and a convex contact surface, the pivot axis and the contact surface of the lever spaced apart to define a movement arm;

a movable ram, the ram having an end with the other of the concave contact surface and the convex contact surface, the contact surface of the ram being engageable with the contact surface of the lever to generate torque;

wherein the contact surface of the lever and the contact surface of the ram are both substantially hemispherical.

2. The angular impact wrench of claim 1 further comprising:

a powered reciprocating hammer operatively arranged with the ram to move the ram.

3. The angular impact wrench of claim 1, further comprising:

a housing to support the lever and the ram.

4. The angular impact wrench of claim 2, further comprising:

a housing to support the lever and the ram.

5. The angular impact wrench of claim 4, further comprising:

a coupler for removably mounting the housing to the powered reciprocating hammer.

6. The angular impact wrench of claim 5, wherein the coupler includes a collar and a guide, the collar adapted to removably connect the coupler to the powered reciprocating hammer, and the guide having a bore therein to receive the ram therethrough and to retain the ram therein.

7. The angular impact wrench of claim 1, further comprising:

an automatic actuating system for automatically actuating the ram upon application of a predetermined amount of torque to the lever.

8. The angular impact wrench of claim 1, further comprising:

a drive connected to the lever, the drive configured to accept a socket thereon.

9. The angular impact wrench of claim 8, wherein the drive includes two opposing ends, each end configured to accept a socket thereon, the first end being rotatable to drive a fastener in a first direction, the second end being rotatable to drive a fastener in a second direction, the second direction opposing the first direction.

10. The angular impact wrench of claim 1, wherein the contact surface of the lever is concave, and the contact surface of the ram is convex.

11. The angular impact wrench of claim 1, wherein the contact surface of the ram substantially conforms to the contact surface of the lever.

12. An angular impact wrench comprising:

a lever rotatable about a pivot axis, the lever including an arm having one of a concave contact surface and a convex contact surface;

a linearly movable ram, the ram having an end with the other of the concave contact surface and the convex contact surface, the ram arranged to act against the lever to urge the lever to rotate, the convex contact surface and the concave contact surface substantially conforming to each other;

a housing, the lever rotatably mounted to the housing, the arm movably disposed within the housing; and a coupler for removably mounting the housing to a powered reciprocating hammer.

13. The angular impact wrench of claim 12, wherein the lever includes a drive.

14. The angular impact wrench of claim 12, wherein the contact surface of the lever is concave, and the contact surface of the ram is convex.

15. An angular impact wrench comprising:

a lever rotatable about a pivot axis, the lever including an arm having one of a concave contact surface and a convex contact surface, the pivot axis and the contact surface of the lever spaced apart to define a movement arm;

a movable ram, the ram having an end with the other of the concave contact surface and the convex contact surface, the contact surface of the ram being engageable with the contact surface of the lever to generate torque;

a reciprocally movable piston for engagement with the ram;

a cylinder for housing the piston;

an air source for reciprocally moving the piston;

an automatic actuating system for automatically actuating the ram upon application of a predetermined amount of torque to the lever, the actuating system in operable engagement with the air source to reciprocally move the piston such that the piston periodically strikes the ram upon application of the predetermined amount of torque to the lever.

16. The angular impact wrench of claim 15, wherein the cylinder includes an interior piston passage, the piston reciprocally disposed within the piston passage, the piston passage including a proximal end, a distal end, and first and second ports thereto, the first and second ports extending between the passage and the exterior surface of the cylinder, the ram extending into the piston passage through the distal end thereof, and wherein the automatic actuating system includes:

a source passage including a seat, the air source passage for directing a source of air to the cylinder, a first branch passage, the first branch passage in fluid communication with the air source passage and the proximal end of the piston passage such that air flow through the first branch passage can act on the piston to drive it toward the distal end of the piston passage and toward the ram, a second branch passage, the second branch passage in fluid communication with the air source passage and the distal end of the piston passage such that air flow through the second branch passage can act on the piston to drive it toward the proximal end of the piston passage and away from the ram, a push rod having a proximal end and a distal end, the proximal end of the push rod being disposed in the air source passage, the push rod having a plug disposed at the proximal end thereof the distal end of the push rod being in contacting relationship with the lever, a return spring disposed in operative relationship with the plug of the push rod such that the plug is biased toward the seat to selectively seal the air source passage, the plug overcoming the spring force of the return spring to move away from the seat to open the air source passage upon the application of the predetermined amount of torque to the lever, and a first spool, a second spool, and a reciprocating disk valve, the spools and the reciprocating disk valve arranged to alternatingly direct air flow through the first and second branch passages in cooperation with the first and second ports of the piston passage to reciprocally move the piston within the piston passage.

17. The angular impact wrench of claim 15, wherein the contact surface of the lever is concave, and the contact surface of the ram is convex.

18. The angular impact wrench of claim 12, wherein the coupler is threaded for threadedly engaging the powered reciprocating hammer.

* * * * *